US005749739A

United States Patent [19]

Saka et al.

[11] Patent Number: 5,749,739

[45] Date of Patent: May 12, 1998

[54] BRANCH CONNECTION DEVICE FOR AN AUTOMOTIVE VEHICLE

[75] Inventors: Yuuji Saka; Hideaki Shibata, both of Yokkaichi, Japan

[73] Assignee: Sumitomo Wiring Systems, Ltd., Japan

[21] Appl. No.: 526,262

[22] Filed: Sep. 11, 1995

[30] Foreign Application Priority Data

Sep. 14, 1994 [JP] Japan ..... 6-220357

[51] Int. Cl.[6] ..... H01R 9/09

[52] U.S. Cl. ..... 439/76.2

[58] Field of Search ..... 439/76.2, 949, 439/723, 724, 34, 638, 540

[56] References Cited

U.S. PATENT DOCUMENTS

| | | | |
|---|---|---|---|
| 4,355,853 | 10/1982 | Kourimsky . | |
| 4,850,884 | 7/1989 | Sawai et al. . | |
| 4,869,675 | 9/1989 | Ogawa . | |
| 4,940,419 | 7/1990 | Kurita et al. | 439/76.2 |
| 4,956,748 | 9/1990 | Yamamoto et al. . | |

FOREIGN PATENT DOCUMENTS

| | | |
|---|---|---|
| 32 10 113 | 3/1982 | Germany . |
| 42 27 182 | 12/1993 | Germany . |
| 62-12321 | 1/1987 | Japan . |

*Primary Examiner*—Neil Abrams
*Assistant Examiner*—Christopher Goins
*Attorney, Agent, or Firm*—Anthony J. Casella; Gerald E. Hespos; Ludomir A. Budzyn

[57] ABSTRACT

To provide a branch connection device for an automotive vehicle which can be applied to a plurality of types of vehicles without enlarging the size thereof only by connecting respective auxiliary connecting members with one device main body, there is provided an auxiliary connecting member (2) which is connectable with a device main body (1) and includes a plurality of auxiliary connector portions engageable with the corresponding connector sockets, a plurality of auxiliary sockets into which connectors connected with ends of wiring harnesses are mounted, a wiring conductor for establishing connections different from specified connections established by an internal circuitry of the device main body between the wiring harnesses and between the wiring harnesses, the fuses and the relays. Internal circuits of the branch connection device can be easily changed and increased only by connecting the auxiliary connecting member 2 with one device main body 1, with the result that this device can be easily applied to a plurality of types of vehicles without enlarging the size thereof as in the prior art.

7 Claims, 10 Drawing Sheets

BRANCH CONNECTION DEVICE FOR AN AUTOMOTIVE VEHICLE

BACKGROUND OF THE INVENTION

1. Field of the Invention

The present invention relates to a branch connection device for an automotive vehicle which device, when fuses and relays are mounted thereon and when connectors connected with a plurality of wiring harnesses are mounted into a plurality of connector sockets formed thereon, establishes specified connections between the wiring harnesses and between the wiring harnesses, the fuses and the relays.

2. Description of the Prior Art

A branch connection device for establishing specified connections between wiring harnesses and between wiring harnesses, fuses and relays is normally designed for each type of vehicles so as to provide an optimal circuitry therefor. Accordingly, a connecting circuitry of a wiring harness realized by a branch connection device for a certain type of vehicles differs from a connecting circuitry of a wiring harness realized by a branch connection device for another type of vehicles. Therefore, the former branch connection device cannot replace the latter branch connection device and vice versa.

In view of the above, there is considered an electric connecting device for an automotive vehicle as disclosed in Japanese Unexamined Patent Publication No. 62-12321. Specifically, a main electronic unit including a basic function circuitry which is required by any type and any grade of vehicles is built in a casing, and an auxiliary electronic unit including a special function circuitry which differs depending upon the type and grade of vehicles is detachably connected with the casing.

In the case of the connecting device as disclosed in the above publication, the main electronic unit includes the common function circuitry which is required by any type and any grade of vehicles, and the auxiliary electronic unit is partially connected with output terminals of the main electronic unit. Accordingly, the connecting circuitry corresponding to a part of the output terminals of the main electronic unit can be suitably changed by the auxiliary electronic unit. However, when the main electronic unit has many output terminals, a plurality of auxiliary electronic units may be required depending upon the arrangement of the output terminals. The mounting of all auxiliary electronic units makes the device larger. Furthermore in the case one of the electronic units fails or has an error no easy replacement of the complete branch connection, i.e. of the main electronic unit along with the auxiliary units, is possible because of the complicated connection with the ends of the wiring harnesses.

Thus, it is an object of the present invention to provide an improved branch connection device for an automotive vehicle which can be easily applied to a plurality of types of vehicles, in particular without enlarging the size thereof by only connecting respective auxiliary connecting members with one device main body.

SUMMARY OF THE INVENTION

A branch connection socket assembly is provided for connecting the conductors of at least one wiring harness of an automotive vehicle to other such wiring harness conductors and/or to at least one circuit control component. The circuit control component may comprise at least one fuse and/or at least one relay. The branch connection socket assembly includes a device main body and an auxiliary connecting member. The device main body includes a first surface with a first plurality of sockets for connection with circuit control components, such as the fuses and/or relays. The device main body further includes a second surface with second plurality of sockets which may be connected electrically to the respective first plurality of sockets by wiring conductors and/or other circuitry within the device main body. The auxiliary connecting member includes a plurality of auxiliary connector portions connectable respectively with the second plurality of sockets on the device main body. The auxiliary connecting member further includes a plurality of auxiliary sockets engageable with the wiring harness conductors. The auxiliary sockets may be electrically connected to one another or to the auxiliary connector portions by a specified array of auxiliary conductors and/or circuitry within the auxiliary connecting member.

By engaging the respective auxiliary connector portions of the auxiliary connecting member with the corresponding connector sockets of the device main body, and by fitting the connectors of the wiring harnesses into the respective auxiliary sockets, the connections between the wiring harness and the fuses, and/or relays become different from the connections that would be established if the wiring harness was connected directly with the device main body. Thus, this connection device can be easily applied to a plurality of types of vehicles, in particular by car manufacturers using the same basic electric and electronic equipment for all or most of their vehicle types, which may have different wire harnesses and/or connectors, without enlarging the size thereof. In addition, in the case one electric or electronic part has an error the device main body housing the electric or electronic part can be easily replaced without the need of detaching the connection with the one or more wiring harnesses.

Preferably, the auxiliary connecting member connectable with the device main body is provided with a plurality of auxiliary connector portions to be fitted into the respective connector sockets, a plurality of auxiliary sockets into which the connectors connected with the ends of the wiring harnesses are mounted, the wiring conductor for establishing connections between the wiring harnesses and between the wiring harnesses, the fuses and the relays, which connections differ from the specified connections established when only the device main body is used. Accordingly, the internal circuits of the branch connection device can be easily changed and increased only by connecting the auxiliary connecting member with one device main body. As a result, this device can be easily applied to a plurality of types of vehicles without enlarging the size thereof as in the prior art, thereby improving a cost performance.

According to a preferred embodiment, the auxiliary connecting member is provided for being fixedly mounted in the automotive vehicle for the connection with the one or more wiring harnesses, wherein preferably a plurality of auxiliary sockets is provided on another surface of the auxiliary connecting member into which the respective connectors and, possibly, connectors connected with ends of the one or more wiring harnesses in addition to the respective connectors are mounted, thereby facilitating a possible replacement of the device main unit.

According to a further preferred embodiment, there is provided at least one auxiliary wiring conductor for establishing connections different from the specified connections between the wiring harnesses and/or between the wiring harnesses, the fuses and/or the relays, thus facilitating the adaptation of a given branch connection device to other types of vehicles.

Preferably, the auxiliary wiring conductor is provided in the auxiliary connecting member or alternatively in an intermediate connecting member provided between the device main body and the auxiliary connecting member. Thus also a subsequent adaptation of the branch connection device to a different or enlarged electric or electronic system, e.g. when an additional electric or electronic equipment is subsequently provided in the vehicle, is advantageously possible.

Preferably, the intermediate connecting member is provided with connector sockets on a surface other than the surfaces provided for connection with the device main body and with the auxiliary connecting member. Thus the connection with subsequently provided additional equipment is easily possible.

Preferably, there is securing means for detachably securing the device main body on the auxiliary connecting member, thus providing a secure connection of the device main body with the auxiliary body, which cannot interrupted accidentally.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENT

Figure 1:
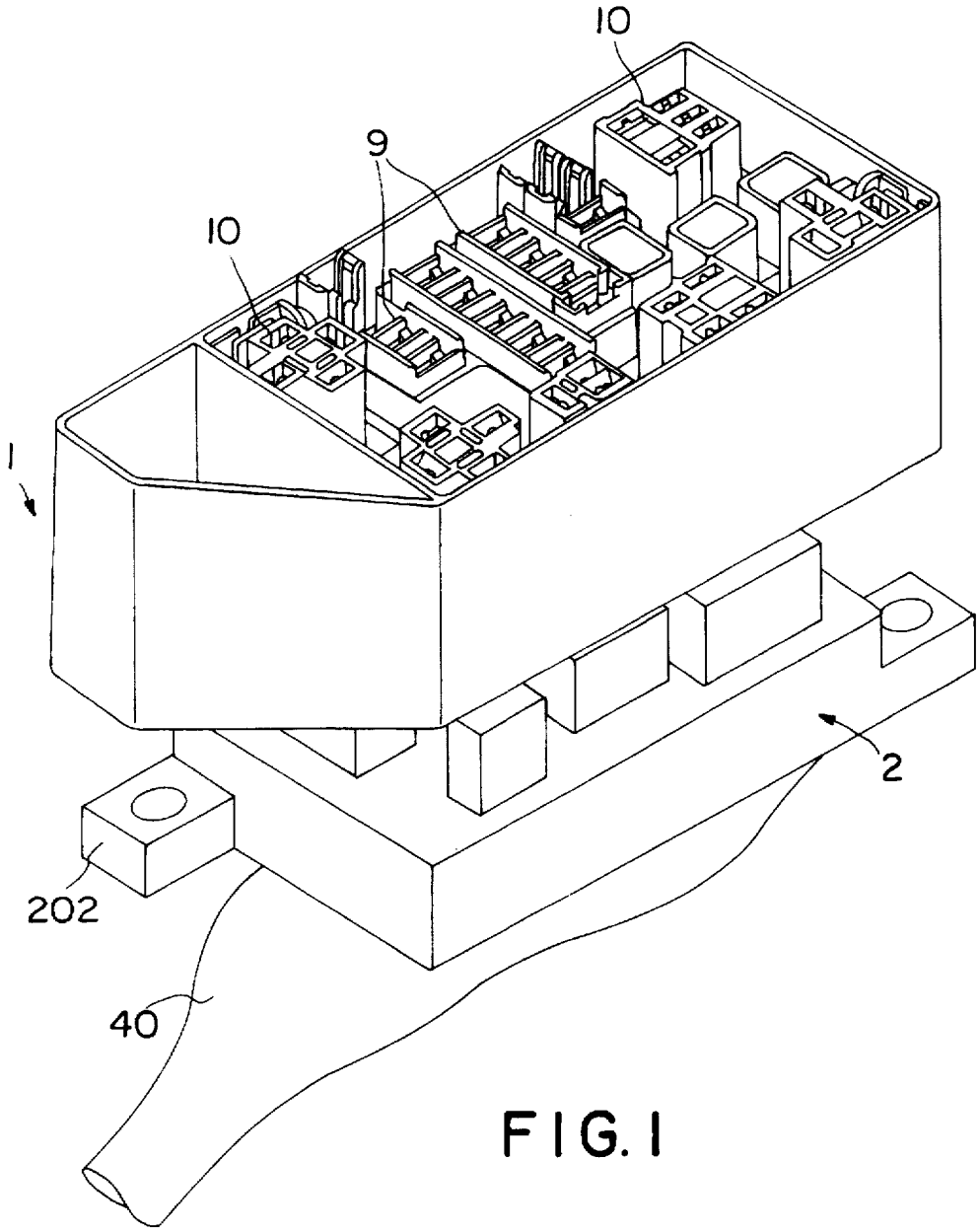
FIG. 1 is a perspective view schematically showing one embodiment of the invention in its separated state.
Figure 6:
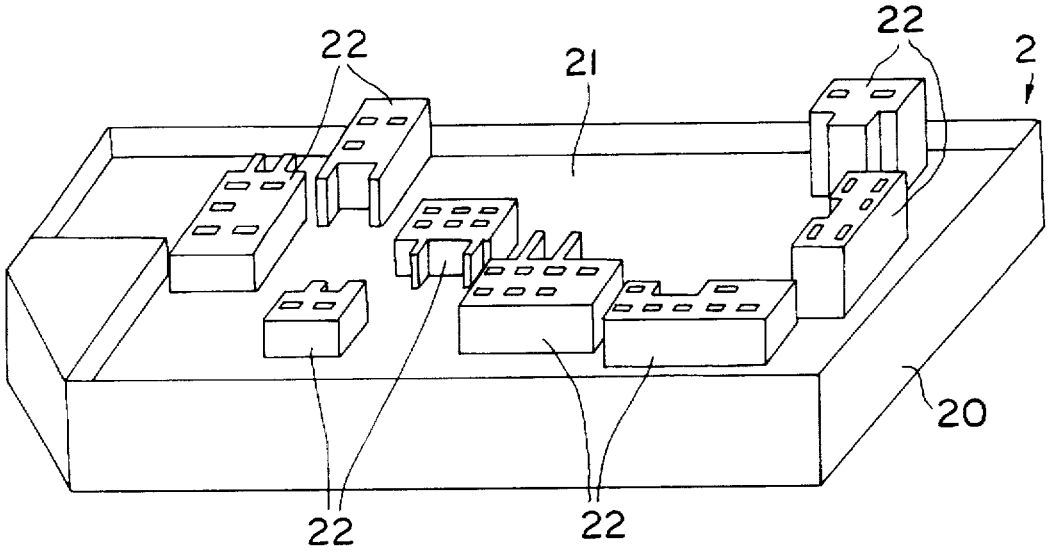
FIGS. 6 and 7 are perspective views of another portion of the embodiment viewed from front and back, respectively.
Figure 7:
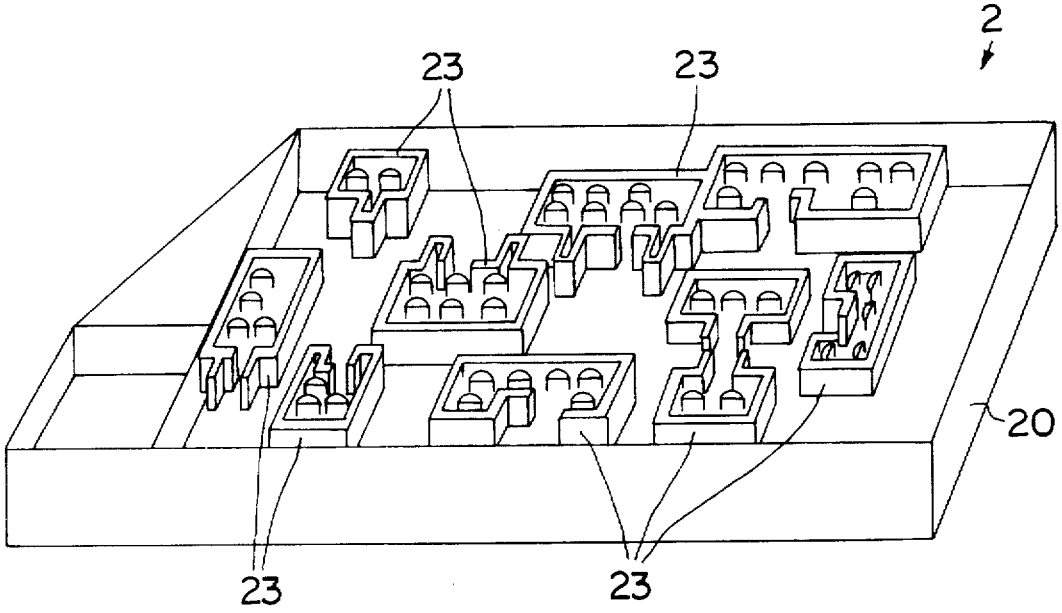

First, the schematic construction is described. As shown in FIG. 1, an upper part of an auxiliary connecting member 2 is detachably engageable with a bottom part of a device main body 1 and a bottom part of the auxiliary connecting member 2 is connected with a wire harness 40. Specifically, the device 1 is constructed as shown in FIGS. 3 to 5, and the auxiliary connecting member 2 is constructed as shown in FIGS. 6 and 7.

Figure 2:
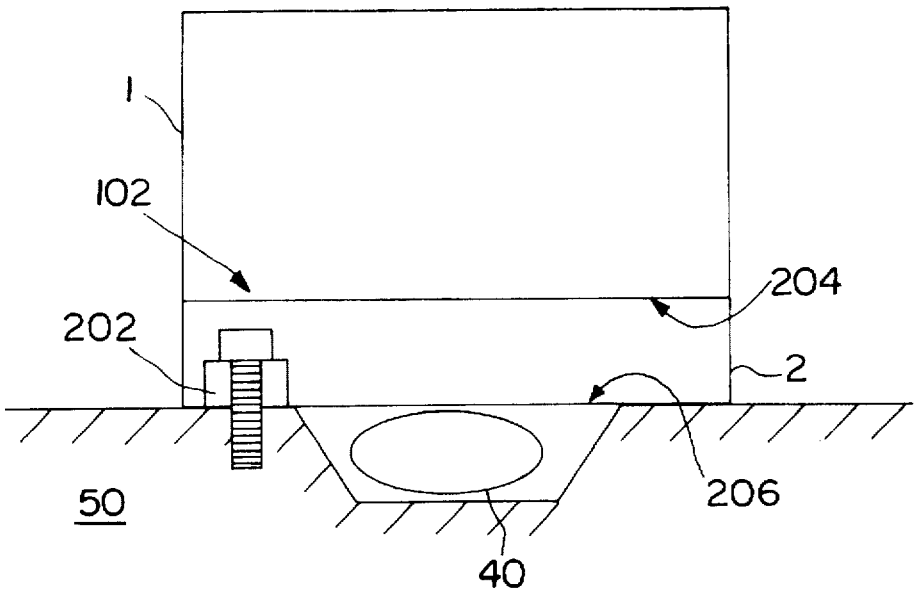
FIG. 2 is a sectional view schematically showing the embodiment of FIG. 1 in its connected state and mounted on a body of a vehicle.

As shown in FIG. 2, the auxiliary connecting member 2 can be mounted on a body 50 of an automotive vehicle by means of mounting means 202, which are integrally formed with the auxiliary connecting member 2. The auxiliary connecting member 2 is interposed between the device main body 1 and a wire harness 40, i.e. the auxiliary connecting member 2 is connected with the device main body 1 on its one side or surface 204 and with a wiring harness 40 on an other side or surface 206, preferably opposing the one side or surface 204.

Figure 3:
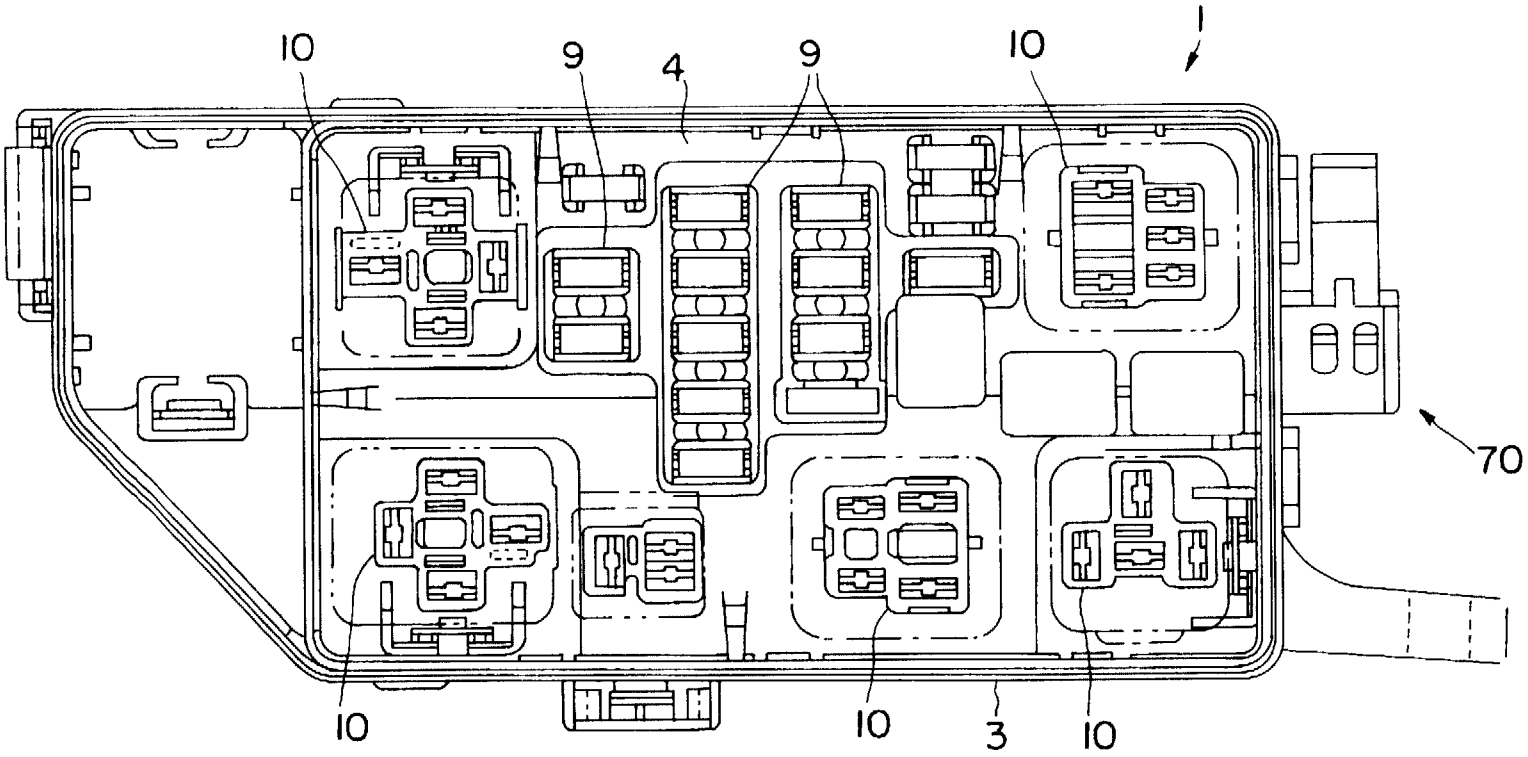
FIGS. 3, 4 and 5 are a plan view, a front view (partly in section) and a bottom view of a portion of a further embodiment of a device main body.
Figure 4:
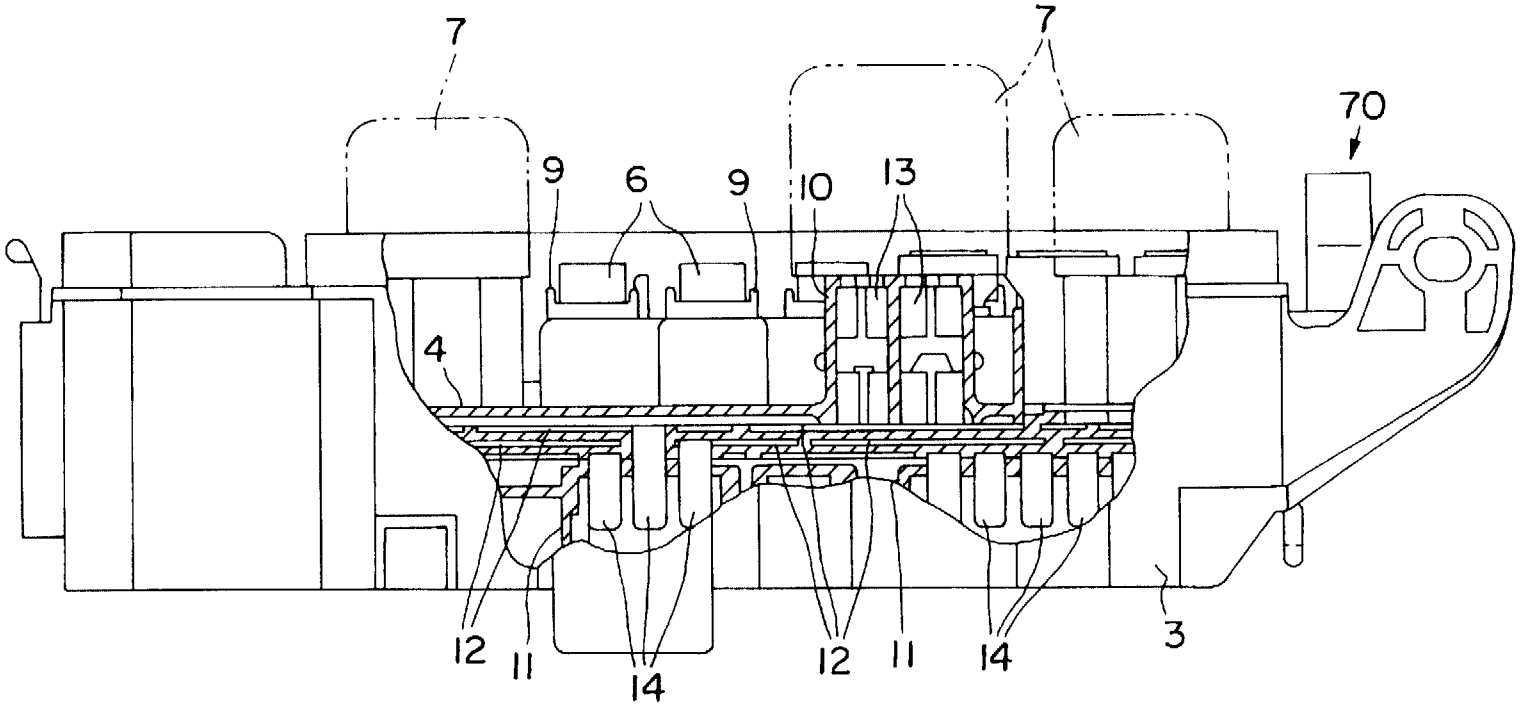
Figure 5:
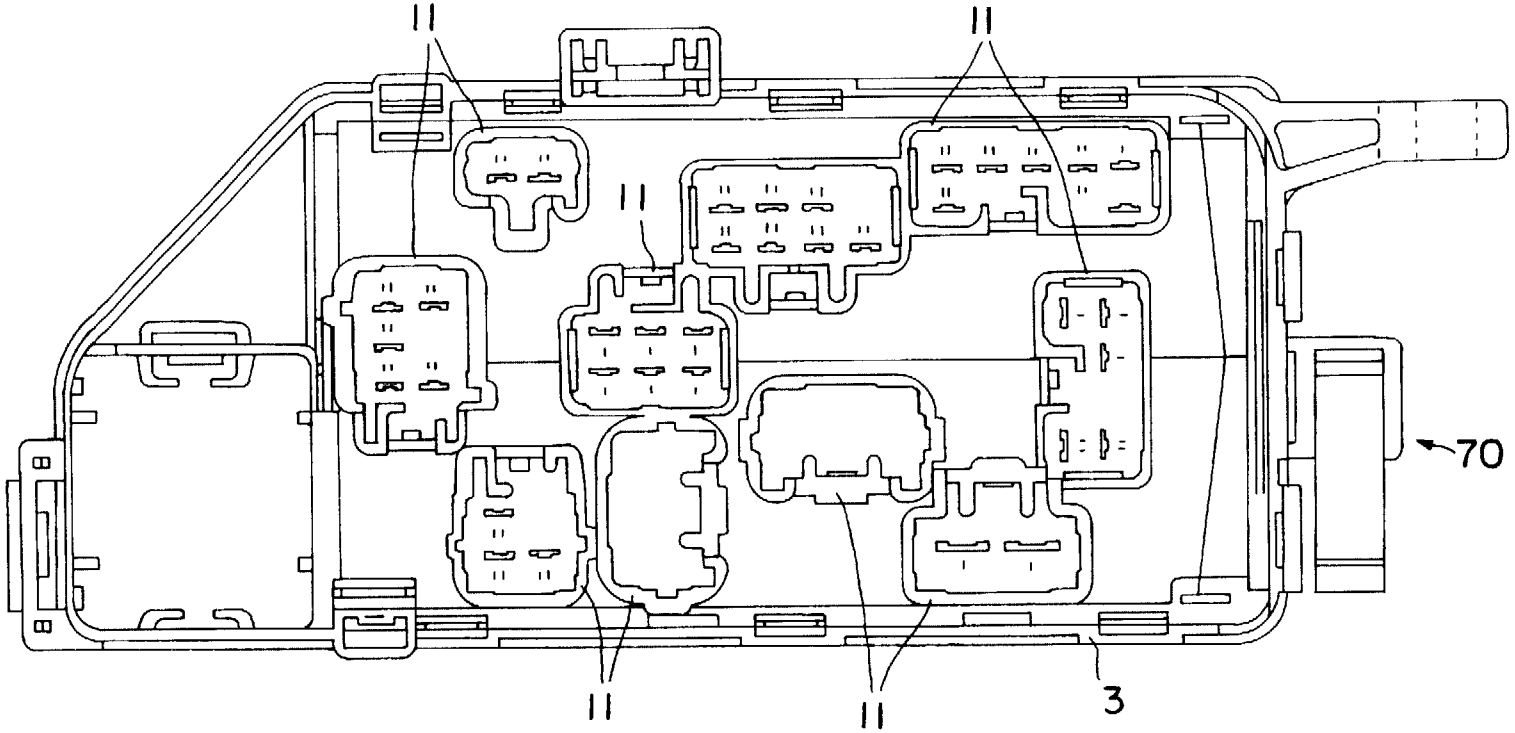

As shown in FIGS. 3 to 5, the device main body 1 includes lower and upper covers 3 and 4 of resin. On the upper surface of the upper cover 4, there are formed a plurality of fuse sockets 9 into which fuses 6 are mounted and a plurality of relay sockets 10 into which relays 7 are mounted. On the lower surface of the lower cover 3, there are formed a plurality of connector sockets 11 into which connectors connected with ends of the wiring harnesses are mounted.

As shown in FIGS. 3 to 5, the device main body 1 may comprise securing means 70 having a pivotable latch, which can secure the device main body 1 on the auxiliary connecting device (not shown) e.g. by interacting with a projection formed on the auxiliary device.

In the device main body 1, busbars 12 as wiring conductors are disposed as shown in FIG. 4. Connecting terminals 14 of the respective sockets 9, 10 and 11 are formed by bent leading ends of the busbars 12 or metal pins 13 welded or soldered with the busbars 12. The fuses, relays and connectors are connected with these connecting terminals 14, respectively.

As shown in FIGS. 6 and 7, the auxiliary connecting member 2 includes lower and upper covers 20 and 21 of resin. On the upper surface of the upper cover 21, as shown in FIG. 6, there are formed a plurality of auxiliary connector portions 22 which are engageable with the connector sockets 11 of the device main body 1 when the auxiliary connecting member 2 is connected with the device main body 10. On the lower surface of the lower cover 20 of the auxiliary connecting member 2, as shown in FIG. 7, there are formed a plurality of auxiliary sockets 23 in which connectors connected with ends of the wiring harness are mounted. Though not shown in FIGS. 6 and 7, busbars as wiring conductors are disposed in the auxiliary connecting member 2. The circuit pattern formed by the wiring busbars differs from that formed by the wiring busbars 12 in the device main body 1. Therefore, connections established between the wiring harnesses and between the wiring harnesses, the fuses and the relays by connecting the auxiliary connecting member 2 with the device main body 1 are different from connections established between the wiring harnesses and between the wiring harness, the fuses and the relays when only the device main body 1 is used.

Connecting terminals of the respective auxiliary connector portions 22 and connecting terminals of the respective auxiliary sockets 23 are formed by the bent leading ends of the wiring busbars in the auxiliary connecting member 2 or metal pins welded or soldered with these busbars.

Figure 8A:
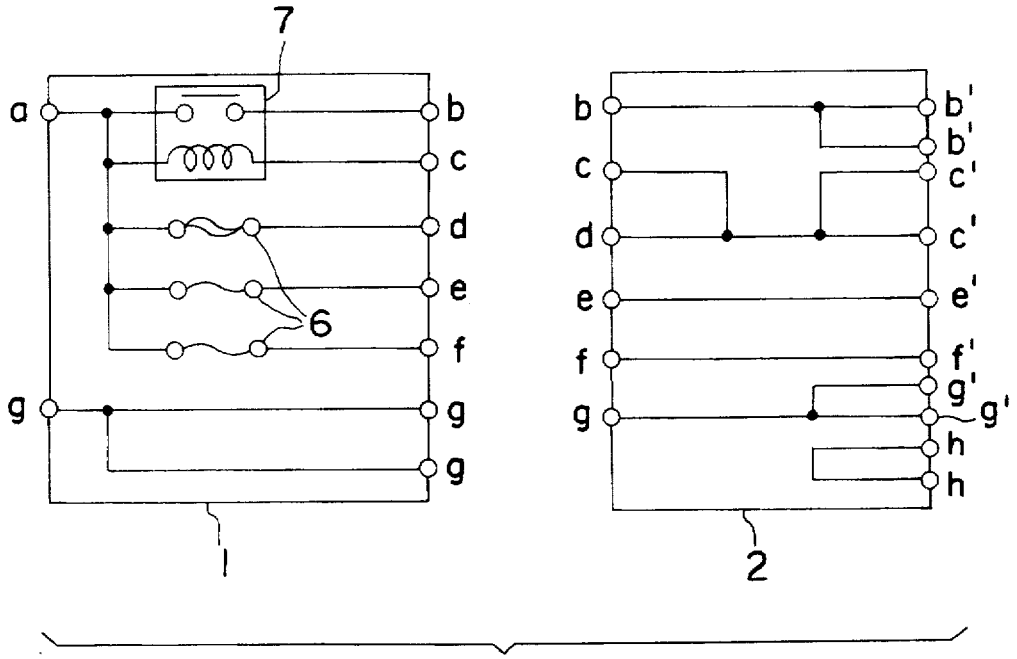
FIG. 8 is a diagram showing a connected state of the embodiment.
Figure 8B:
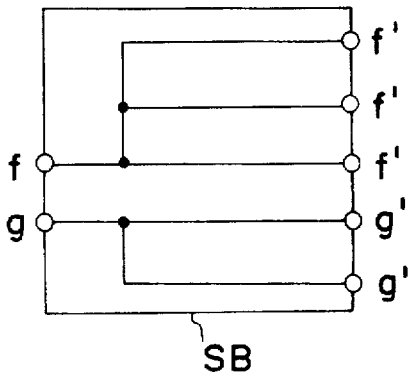

Let it be assumed that a connecting circuitry of the device main body 1 when the fuses 6 and the relays 7 are mounted in the fuse sockets 9 and the relay sockets 10, respectively is, for example, as shown in FIG. 8(*a*). The connecting circuitry of the auxiliary connecting member 2 is shown in FIG. 8(*b*). The respective connecting terminals 14 of the connector sockets 11 of the device main body 1 are identified by a, b, c, d, e, f, g; the respective connecting terminals of the auxiliary connector portions 22 by b, c, d, e, f, g; and the respective connecting terminals of the auxiliary sockets 23 by b', c', e', f', g', h. By connecting the auxiliary connecting member 2 with the device main body 1, the connecting terminals b, c, d, e, f, g of the connector sockets 11 of the device main body 1 are connected with the connecting terminals b, c, d, e, f, g of the auxiliary connector portions 22 of the auxiliary connecting member 2, respectively. By way of the internal circuitry of the auxiliary connecting member 2, the connecting terminal b is changed to two connecting terminals b', b'; the connecting terminal c to the connecting terminal c'; the connecting terminal d to the connecting terminal c'; the connecting terminals e, f to the connecting terminals e', f'; and the connecting terminal g to two connecting terminals g', g'. Further, two connecting terminals h, h are newly added.

A sub-unit SB as shown in FIG. 8(*b*) may be provided. The connecting terminals f, g are connected with the connecting terminals f, g of the connector sockets 11 of the device main body 1 as shown in FIG. 8(*a*), respectively. The sub-unit SB has an internal circuitry which multiplies the connecting terminal f to three connecting terminals f', f', f' and the connecting terminal g to two connecting terminals g', g'. Even in this case, the internal circuits can be multiplied and changed similar to the case shown in FIG. 8(*a*) by connecting the connecting terminals 14 of the connector sockets 11 of the device main body 1 with the corresponding connecting terminals of the auxiliary connector portions 22 of the auxiliary connecting member 2.

Figure 9:
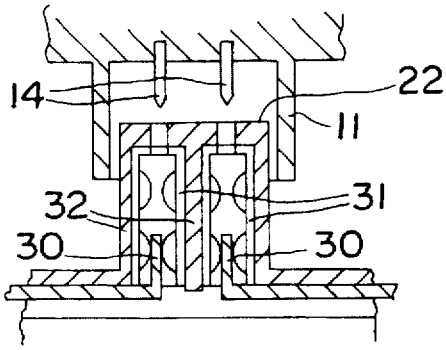
FIGS. 9, 10 and 11 are diagrams showing the connecting operation of the embodiment.
Figure 10:
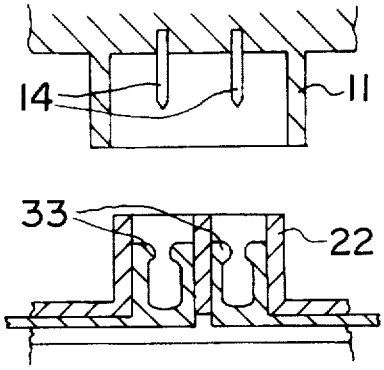
Figure 11:
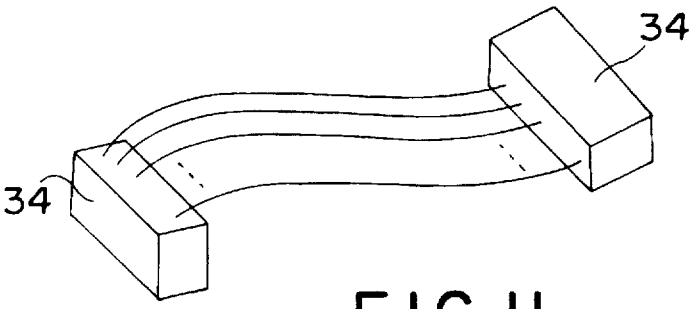

The connection between the connecting terminals 14 of the connector sockets 11 of the device main body 1 and the connecting terminals of the auxiliary connector portions 22 of the auxiliary connecting member 2 may be established by way of connecting terminals 32 formed by intermediate terminals 31 connected with the wiring busbars 30 provided in the auxiliary connecting member 2, as shown in FIG. 9. Alternatively, this connection may be established by way of wiring busbars 33 having terminal portions extending into the auxiliary connector portion 22, as shown in FIG. 10. Further, the connection may be established by way of wiring cables provided with connectors 34 as shown in FIG. 11.

The auxiliary connecting member 2 is detachably connectable with the device main body 1. The respective auxiliary connector portions 22 are fitted into the corresponding connector sockets 11 of the device main body 1 when the device main body 1 and the auxiliary connecting member 2 are connected. The connectors of the wiring harnesses are mounted into the respective auxiliary sockets 23. Accordingly, the connections established between the wiring harnesses and between the wiring harness, the fuses and the relays are different from those established when the wiring harnesses and the like are connected only by the device main body 1. Therefore, the internal circuits of the branch connection device can be easily changed and increased only by connecting the auxiliary connecting member 2 with the device main body 1, with the result that this device can be easily applied to a plurality of types of vehicles without enlarging the size thereof as in the prior art.

Figure 12:
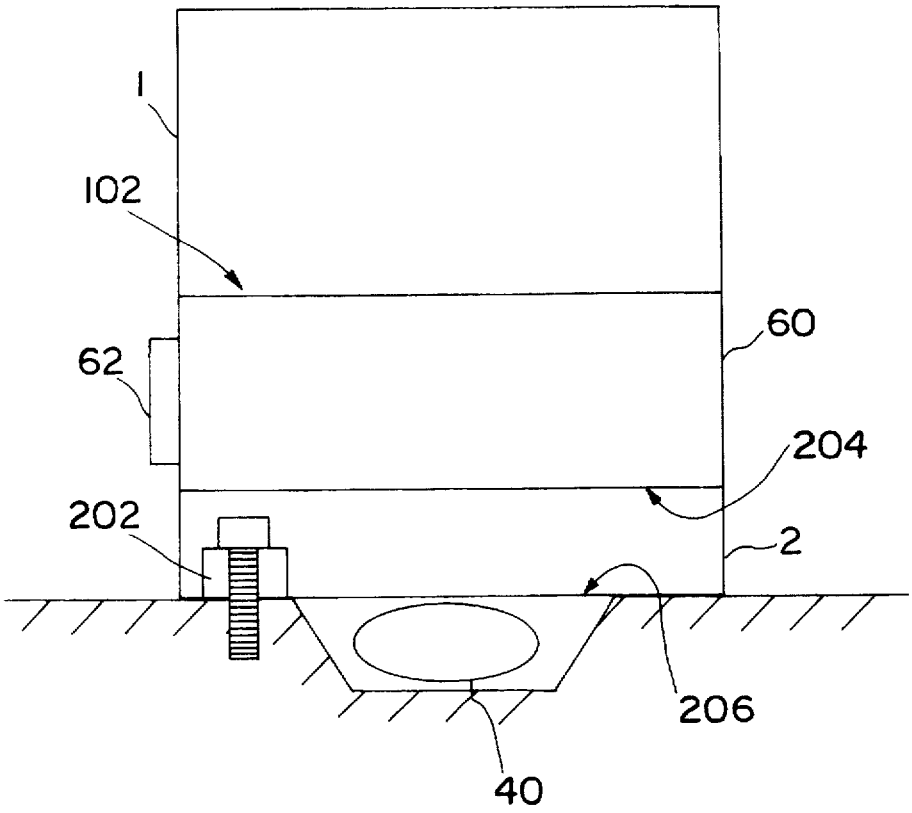
FIG. 12 is a sectional view schematically showing a further embodiment in its connected state and mounted on a body of a vehicle.

In a further embodiment, as shown in FIG. 12, there is interposed an intermediate connecting member 60 between the device main body 1 and the auxiliary connecting member 2. The intermediate connecting member 60 can be provided in particular at a later stage for containing wire connections to adapt the electric connections and/or the electronic units e.g. to a subsequent modification due to the addition of further equipment. The intermediate connection member 60 is provided with connection means 62 on a side or surface other than the sides or surfaces provided for the connection with the device main body 1 and auxiliary connecting member 2. The intermediate connecting member 60 is provided with (not shown) connectors and/or sockets for connecting it with the device main body 1 and auxiliary connecting member 2.

Figure 13A:
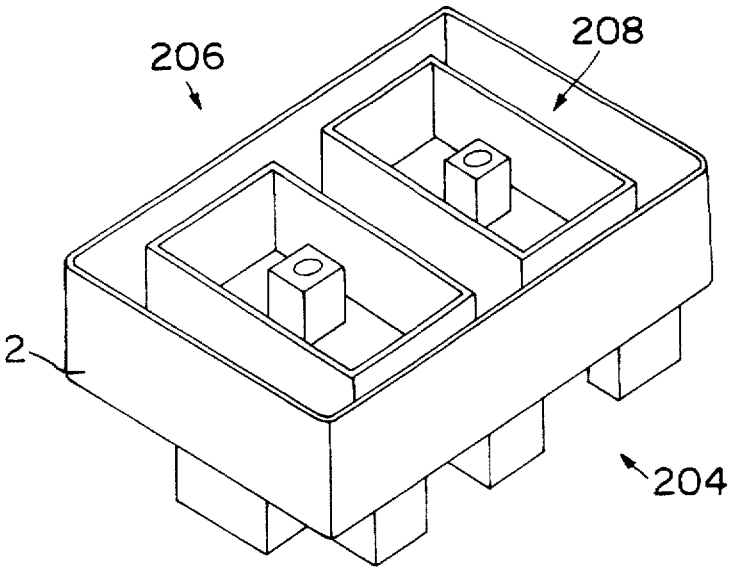
FIGS. 13A and 13B show two different embodiments of an auxiliary connector from below.
Figure 13B:
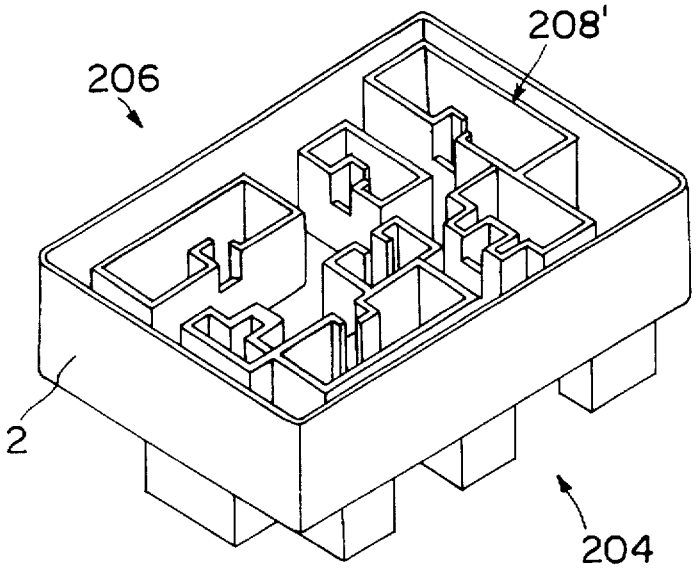

As shown in FIGS. 13A and 13B, the auxiliary connecting device can be provided on its lower side or surface 206 facing the wire harness (not shown) with different patterns 208, 208' of connectors and/or sockets, in particular for the connection with different types of wiring harnesses, sockets and/or connectors.

What is claimed is:

1. A branch connection device for connecting a plurality of circuit control components (6, 7) to at least one wiring harness (40) of an automotive vehicle, comprising:

a device main body (1) having first and second surfaces, a plurality of circuit control sockets (9, 10) provided on the first surface of the device main body (1) and into which a plurality of the circuit control components (6, 7) are connectable, respectively, a plurality of connector sockets (11) provided on the second surface of the device main body (1) and being disposed and configured for connection with conductors of the at least one wiring harness (40), wiring conductors (12) in the device main body (1) and between the first and second surfaces thereof for establishing specified connections of each said connector socket (11) to at least one other of said sockets (9, 10, 11) of said device main body (1), an auxiliary connecting member (2) having a first surface and a second surface, a plurality of auxiliary connector portions (22) provided on the first surface of the auxiliary connecting member (2), said plurality of auxiliary connector portions (22) being disposed and configured for detachably engaging a plurality of the respective connector sockets (11) on the second surface of the device main body (1), a plurality of auxiliary sockets (23) provided on the second surface of the auxiliary connecting member (2), the auxiliary sockets 23 being connected with the conductors of said at least one wiring harness (40), at least one auxiliary wiring conductor connected to at least one said auxiliary socket (23) for enabling connections between the conductors of the at least one wiring harness (40) and the circuit control components (6, 7) that are different from the specified connections established by the wiring conductors (12) of the device main body (1), and an intermediate connecting member (60) between the device main body (1) and the auxiliary connecting member (2), the auxiliary wiring conductor being at least partly disposed in the intermediate connecting member (60).

2. A branch connection device according to claim 1, wherein the auxiliary connecting member (2) includes means (202) for fixedly mounting the auxiliary connecting member (2) in the automotive vehicle.

3. A branch connection device according to claim 1, wherein the auxiliary wiring conductor is partly provided in the auxiliary connecting member (2).

4. A branch connection device according to claim 1, wherein the intermediate connecting member (60) is provided with connecting means (62) on a surface other than the surfaces provided for connection with the device main body (1) and with the auxiliary connecting member (2) for connection to additional circuitry.

5. A branch connecting device according to claim 1, further comprising securing means (70) for detachably securing the device main body (1) on the auxiliary connecting member (2).

6. A branch connecting device according to claim 1, wherein the circuit control sockets (9, 10) of the device main body (1) include at least one fuse socket (9) into which a fuse (6) is connectable.

7. A branch connecting device according to claim 1, wherein the circuit control sockets (9, 10) of the device main body (1) include at least one relay socket (10) into which a relay (7) is connectable.

* * * * *